United States Patent [19]

Ellingsen et al.

[11] 4,320,908

[45] Mar. 23, 1982

[54] SKIS

[75] Inventors: Olav Ellingsen, Florø; Olav Åsnes, Straumsnes, both of Norway

[73] Assignee: Åsnes Skifabrikk A/S, Straumsnes, Norway

[21] Appl. No.: 141,469

[22] Filed: Apr. 18, 1980

[30] Foreign Application Priority Data

Mar. 5, 1980 [NO] Norway ..... 800631

[51] Int. Cl.[3] ..... A63C 7/06

[52] U.S. Cl. ..... 280/604

[58] Field of Search ..... 280/604, 609, 601; D21/229

[56] References Cited

U.S. PATENT DOCUMENTS

| | | | |
|---|---|---|---|
| 3,858,894 | 1/1975 | Ver et al. | 280/604 |
| 4,118,050 | 10/1978 | Schnurrenberger | 280/604 |
| 4,223,909 | 9/1980 | Dannor et al. | 280/604 |

FOREIGN PATENT DOCUMENTS

| | | | |
|---|---|---|---|
| 1059327 | 6/1959 | Fed. Rep. of Germany | 280/604 |
| 808359 | 2/1937 | France | 280/604 |

*Primary Examiner*—David M. Mitchell

*Attorney, Agent, or Firm*—Wegner, Stellman, McCord, Wood & Dalton

[57] ABSTRACT

A ski having a so-called waxless plastic sole wherein a pattern in the form of a plurality of rearwardly-directed curbs is provided in the running surface of the sole. The pattern consists of a plurality of arc-shaped, wedge-formed cuts wherein the center of the arcs lies to one side of the longitudinal central plane of the ski, and a plurality of arc-shaped, wedge-formed cuts which intersect said first cuts. The center of the latter arcs are lying on the other side of the central longitudinal plane of the ski.

5 Claims, 4 Drawing Figures

SKIS

Figure 1:
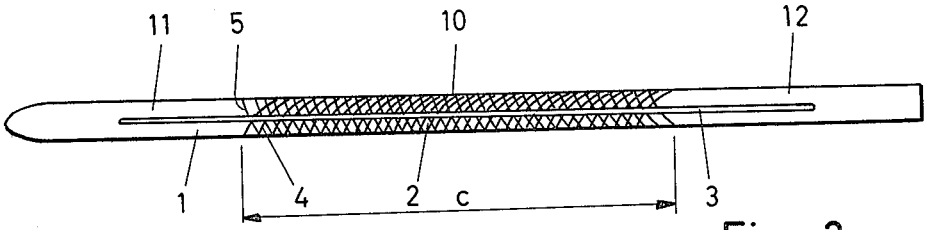

The present invention relates to an improvement on skis having so-called waxless (no-wax) plastic soles, wherein a pattern in the form of a large number of rearwardly-directed curbs is provided in the running surface of the ski.

To help the skier obtain good forward slide and to prevent backslipping when pushing off, various waxes have been applied to the soles of skis. One must apply different types of waxes for different temperatures, types of snow, etc. The proper waxing of skis is therefore a very difficult technique, an art which is certainly not mastered by all the people who ski, and a no-wax ski has always been a desired goal. The first no-wax skis were coated with fur on the sole surface, with the hairs of the pelt facing backwards. The ski then slid forward easily, and the hairs acted as curbs against a back-slipping movement in the opposite direction. Such ski soles, however, did not wear very well, and would with today's fur prices be very expensive.

Lately, several types of skis with plastic soles have come on the market in which patterns in the form of a plurality of rearwardly-directed curbs have been cut or imprinted in the plastic sole. Some of these patterns have the form of transverse, wedge-shaped notches with the deepest part of the notch directed toward the front of the ski. Another type of waxless ski has a sole with a fish-scale design, the rounded edge of the scale being directed toward the back of the ski. On both of these types of skis, one has a form of rearwardly-directed curbs and forward-sloping, upwardly-directed sliding surfaces.

In the first design, the crosswise notches are usually chiseled, cut or milled into the plastic sole of a finished ski. The other type of pattern, the fish-scale design, is impressed in the sole during the production of the sole coating. Such a coating is inexpensive, but has the disadvantage that it can become deformed during the press-molding of the ski. Neither is there any possibility of changing this pattern in accordance with different lengths of skis. The first pattern, with straight, crosswise notches, provides a ski having little lateral stability.

The object of the present invention is to arrive at a plastic ski sole having a pattern in the running surface thereof, which provides good sliding and gripping capabilities, gives good lateral stability, is easy to produce after the ski has been manufactured, and in which the pattern has the same depth along its entire length. Another object of the invention is to provide a pattern which does not produce any sound as a result of resonance in the ski, because it is common knowledge that most of the skis with patterned running surfaces produce a whistling noise during use. This is because the pattern is uniform under the entire ski sole, and resonance in the ski can then easily arise.

The above goals are realized by an improvement on a ski of the type defined above, which is characterized in that the pattern consists of a plurality of arc-shaped, wedge-formed cuts wherein the center of the arcs lies to one side of the central longitudinal plane of the ski, and a plurality of arc-shaped, wedge-formed cuts which intersect said first cuts, the center of the latter arcs lying on the other side of the central longitudinal plane of the ski.

A preferred embodiment of the invention is characterized in that the distance between cuts is unequal. A further development of this feature is characterized in that the distance between cuts is smallest at the middle of the ski and increases toward the ends, the ratio between the largest interstice and the smallest being about 2.5:1.

A further feature of the invention is that the pattern extends over only about half of the length of the ski and is disposed approximately symmetrically on both sides of the boot binding section of the ski.

Figure 2:
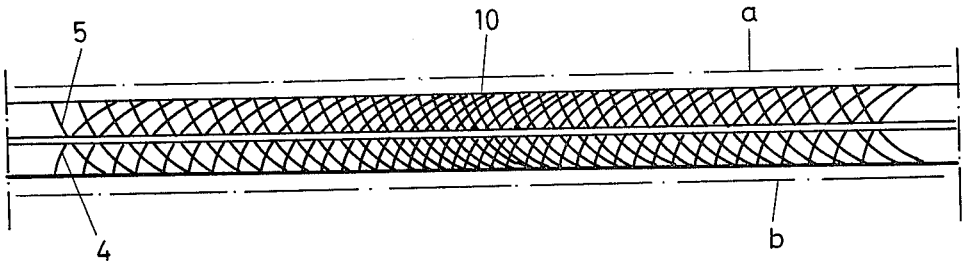
Figure 3:
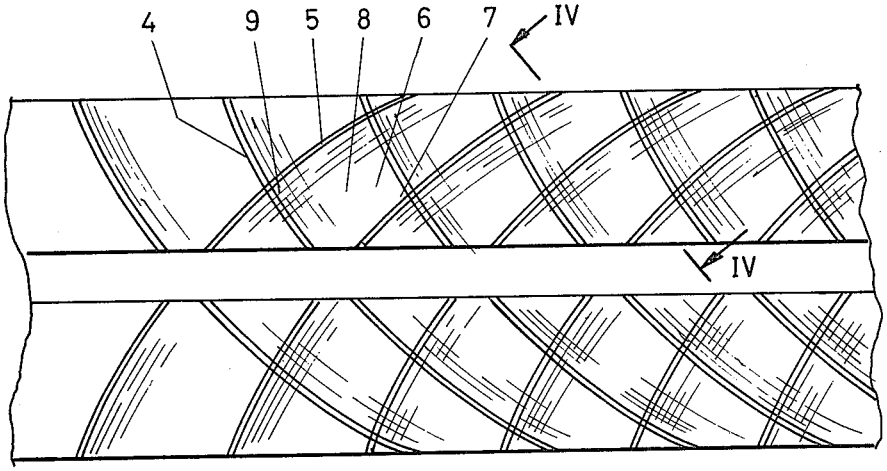
Figure 4:
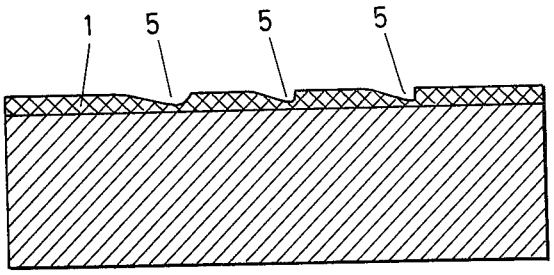

The invention will be elucidated in greater detail in the following with reference to the accompanying drawings, where FIG. 1 shows a ski according to the invention, viewed from the sole side, FIG. 2, on a somewhat larger scale, shows the middle portion of the ski of FIG. 1, FIG. 3 is an even greater enlargement of a part of the sole pattern, and FIG. 4 is a cross section along line IV—IV in FIG. 3.

In FIG. 1, which shows an embodiment of a ski in accordance with the invention, the sole 1 is of plastic and has a pattern 2 in the middle section thereof. In the example illustrated, the pattern is broken by a longitudinal steering groove 3. There is no reason, however, that the steering groove cannot be relatively shallow and the pattern cut so deeply that the bottom of the groove will also be imprinted. As can be seen in FIGS. 1, 2 and 3, the pattern consists of arc-shaped cuts 4 which run diagonally in relation to the transverse direction of the ski, the center of the arcs lying to one side of the longitudinal center plane of the ski, in the illustrated example, at the dotteddashed line b. These cuts are intersected by oppositely-running, U-shaped cuts 5, whose centers similarly lie to one side of the central plane of the ski, at the dotted-dashed line a. As seen in particular in FIG. 3, by means of the arc-shaped cuts 4 and 5, rearwardly-directed peaks or curbs 6 are formed, whose shape from the highest point at 7 slopes gradually along an inwardly directed inclined surface 8 to the deepest point at 9.

As seen especially well in FIG. 2, the cuts 4 and 5 can be made in a very simple manner by means of a steel cutter or the like which rotates with its center at the lines a and b. The cuts can be produced very quickly and with simple tools, and one can vary the distance between cuts as desired. This pattern gives good lateral stability, because the cuts 4 and 5 run diagonally in relation to the transverse direction of the ski.

As can be seen in FIGS. 1 and 2, the cuts 4 and 5 are spaced closer together at the middle 10 of the ski, and the pattern is made over a length l which is less than the total length of the ski and is placed approximately symmetrically about the middle 10 of the ski.

Owing to the unequal spacing between the cuts 4 and 5, one will not obtain resonance in the ski when the ski is moved over a snow surface, as often occurs when the cuts are equidistantly spaced along the entire length of the pattern. Because the length l is less than the length of the ski proper, such that there are non-patterned sections 11 and 12 at both the front and rear portions of the ski, one obtains a ski with improved sliding capability. The pattern covers only the portion of the ski sole which is most actively used when pushing off.

Having described our invention, we claim:

1. An improvement on a ski having a so-called waxless (no-wax) plastic sole wherein a pattern in the form of a plurality of rearwardly-directed curbs is provided in the running surface of the sole, characterized in that the pattern consists of a plurality of arc-shaped, wedge-formed first cuts wherein the center of the arcs lies to one side (b) of the longitudinal central plane of the ski, and a plurality of arc-shaped, wedge-formed second cuts which intersect said first cuts, the center of the latter arcs lying on the other side (a) of the central longitudinal plane of the ski, each of said first and second cuts project across and intersect on both sides of said longitudinal central plane.

2. An improvement according to claim 1, characterized in that the distance between successive cuts is unequal.

3. An improvement according to claim 2, characterized in that the distance between successive cuts is smallest at the middle of the ski and increases toward the ends, the ratio between the greatest interstice and the smallest being about 2.5:1.

4. An improvement according to claim 1, characterized in that the pattern extends over only about one-half of the length of the ski and is disposed approximately symmetrically about the middle of the ski.

5. An improvement according to claim 1 wherein said first and second cuts are at a uniform depth.

* * * * *